US008593274B2

(12) United States Patent
Gancarcik et al.

(10) Patent No.: US 8,593,274 B2
(45) Date of Patent: Nov. 26, 2013

(54) DIGITAL TELEPHONY DISTRESSED SOUND DETECTION

(75) Inventors: Edward Peter Gancarcik, Ottawa (CA); Philippe Moquin, Kanata (CA)

(73) Assignee: Mitel Networks Corporation, Ottawa, Ontario (CA)

( * ) Notice: Subject to any disclaimer, the term of this patent is extended or adjusted under 35 U.S.C. 154(b) by 533 days.

(21) Appl. No.: 12/924,845

(22) Filed: Oct. 6, 2010

(65) Prior Publication Data

US 2012/0086570 A1 Apr. 12, 2012

(51) Int. Cl.
*G08B 1/08* (2006.01)

(52) U.S. Cl.
USPC ..... 340/533; 340/506; 340/3.3; 340/3.5; 340/692; 379/41; 379/51; 379/88.25

(58) Field of Classification Search
USPC ..... 340/506, 3.3, 3.5, 692; 379/41, 51, 379/88.25
See application file for complete search history.

(56) References Cited

U.S. PATENT DOCUMENTS 7,391,315 B2 * 6/2008 Friar ..... 340/506
2006/0107298 A1 * 5/2006 Friar ..... 725/108

FOREIGN PATENT DOCUMENTS

EP 1708450 A2 4/2006

* cited by examiner

*Primary Examiner* — Daryl Pope

(57) ABSTRACT

A system and method for monitoring for a distressed sound is disclosed. The system comprises a noise detection module configured to monitor ambient noise through a microphone on a digital telephony device operating in an idle state and determine an ambient noise level. A sound processing module is configured to process sounds received from the microphone that have an amplitude a selected amount greater than an amplitude of the ambient noise and determine if the processed sounds match a predetermined statistical model of a distressed sound. An assistance request module is configured to send a request for assistance via the digital telephony device for processed sounds that match the predetermined statistical model of the distressed sound.

20 Claims, 3 Drawing Sheets

DIGITAL TELEPHONY DISTRESSED SOUND DETECTION

BACKGROUND

Employee safety and security are considered to be very important in the workplace. Companies often spend significant amounts of time and money training employees and providing security features to ensure their safety. However, even companies that have significant financial resources are limited in the amount of infrastructure that can be installed. It is often difficult to detect danger or accidents in substantially every part of a factory or office building. This can be especially true for employees working during non-core business hours, such as at night or during the weekend. The increased risk can be costly to both employees and companies.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
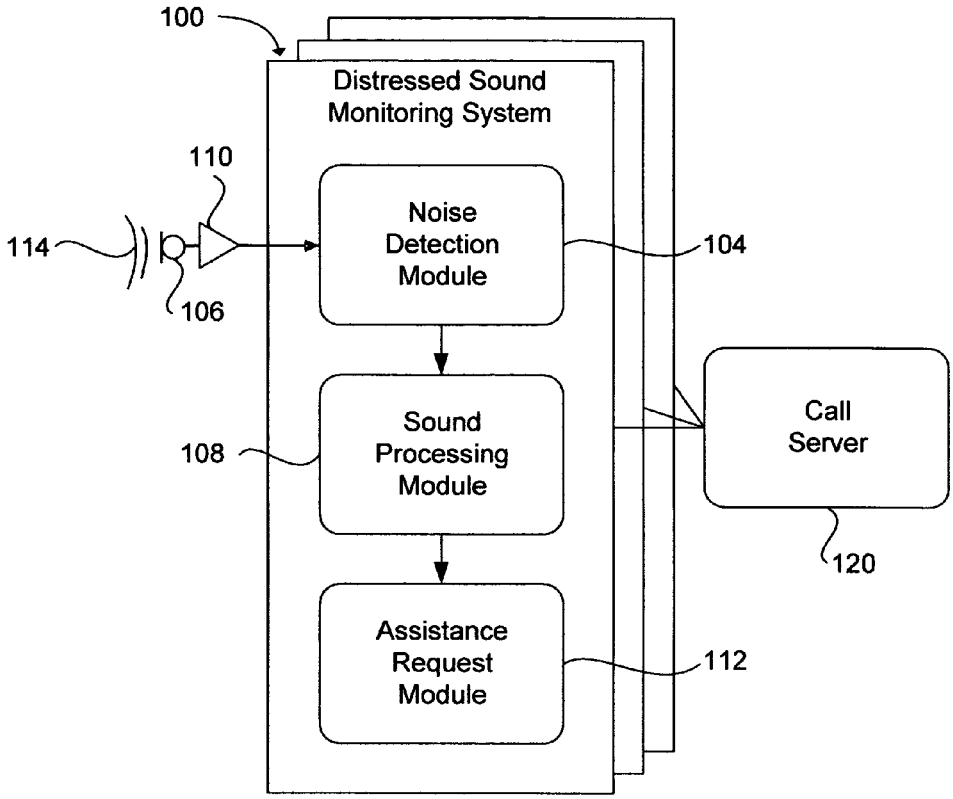
FIG. 1 illustrates a block diagram of an example system for monitoring for a distressed sound in accordance with one example embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

Definitions

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, the term "array of digital telephony devices" include two or more digital telephony devices in communication with a single telephony server.

Example Embodiments

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter. The following definitions are provided for clarity of the overview and embodiments described below.

The use of digital telephony networks in businesses is quickly becoming ubiquitous. Office buildings, factories, and other places of business often have hundreds, or even thousands of telephones distributed throughout a building. The digital telephones can offer a wide variety of services, such as call forwarding, teleconferencing, and even video phone conferencing.

The digital telephones receive and transmit digital information containing the voice and data used in modern day communications. Each digital telephone typically includes a digital signal processor (DSP) or other type of microprocessor used to process audio to digital packets and vice versa. When the telephones are not in use then these microprocessors are typically substantially idle.

With the wide distribution of telephones throughout a building, telephones can be employed to monitor conditions throughout a building. Many types of office phones include a hands-free microphone that can be used for teleconferencing. The hands-free microphone in a standard desktop phone typically includes a high gain amplifier that is specifically designed to detect and amplify voices.

In accordance with one embodiment of the present invention, telephones that are not in use can be configured to monitor ambient noise and to detect selected distressed sounds that may signify a need for help. The telephones can then send a distress call to a predetermined phone number with a message asking for assistance at the location where the distressed sound occurred.

The ability to use existing infrastructure in office buildings to provide added security is a significant benefit to businesses. Employees and other occupants of a building can also benefit from knowing that help can be summoned from almost any location within a building.

For instance, an employee with access to a lab may go to work on a weekend to complete a project. An accident, such as an explosion or chemical spill may occur in the lab that may render the employee unable to locate a phone or other emergency activation device. If additional employees are not present in the lab then the employee may have difficulty obtaining assistance.

However, a number of phones are likely positioned throughout the lab. One or more of the phones can be configured to monitor the sounds in the lab through the microphone (s) available on one or more of the phones. The sounds detected by each microphone can be processed and analyzed by the digital signal processor in the corresponding phone. While a digital signal processor is commonly used in examples throughout the specification it can be appreciated that other types of processors may also be used to process the detected sounds, such as a field programmable gate array (FPGA) processor, a central processing unit, a microcontroller, an application specific integrated circuit (ASIC), and the like. If the processed sound matches a predetermined acoustic model of a distressed sound then one or more of the phones in the lab can send a request for assistance that is related to the distressed sound.

Predetermined statistical models can be words or phrases, such as "HELP", "HELP ME", "FIRE", and so forth. A predetermined statistical model can also be created for other types of sounds that may signify an accident or emergency, such as the sound of breaking glass, the sound of an explosion, the sound of a gunshot, or an extended period of loud communication such as shouting. This will be described in more detail below.

When the digital signal processor in the phone determines that a detected sound substantially matches one or more of the predetermined statistical models then a request for assistance can be sent via the phone to a predetermined destination, such as to company security or an external emergency response group such as the local police. The request for assistance may include information, such as the type of sound detected. For instance, a message can be sent identifying whether the detected sound was a call for help, a gun shot, an explosion, or other type of distressed sound. Such information can enhance the response team's ability to respond effectively to the emergency.

One difficulty in monitoring sounds that occur in a typical school, business, or other type of building is the detection of unintended words or phrases. For example, a person may ask a colleague for help with an assignment. The vocalization of this word may be received and analyzed by one or more phones in the vicinity, resulting in a request for assistance from a sound that is incorrectly interpreted as a distressed sound. The detection of everyday language could potentially create a large number of false positives reported as distressed sounds.

In accordance with one embodiment of the present invention, a digital telephone can be configured to monitor ambient noise levels within a room. An average ambient noise level can be measured over a predetermined period. When audio is detected with an amplitude that is a selected amount greater than the ambient noise level then that audio can be processed by the digital signal processor in the digital telephone to determine if the processed sound matches a predetermined acoustic model of a distressed sound, as previously discussed. The number of false positives can be significantly reduced by limiting the audio that is compared with statistical models to sounds that are a selected amount greater than the ambient noise level in a room.

FIG. 1 illustrates an example system 100 for monitoring for a distressed sound in accordance with one example embodiment of the present invention. The system is comprised of a noise detection module 104, a sound processing module 108, and an assistance request module 112.

The noise detection module 104 is configured to monitor ambient noise through a microphone 106 on a digital telephony device that is operating in an idle state. The microphone may be a hands-free type microphone, or another type of microphone, such as the microphone in the telephone's handset or a built-in microphone in a wireless telephony device.

An idle state is a state in which the telephone is not being used for communication. The term "idle state" is also commonly referred to as "on hook", signifying that the handset is on the phone. When the digital telephony device is in an idle state then the microphone 106 can be used to receive ambient sounds. The sounds are converted by the microphone to an electrical signal. The signal from the microphone may be amplified by an amplifier 110. An average amplitude of the acoustic energy 114 received at the microphone is referred to herein as the ambient noise level.

The ambient noise level received by the microphone 106 can be determined in a number of ways. For example, the acoustic energy may be monitored for a selected interval of time, such as 2 seconds. The amplitude of the noise level can be averaged over the selected interval of time to determine the ambient noise level. The amplitude may be measured with respect to a base line or another type of respective level. A number of other techniques may also be used to measure an average ambient sound amplitude level, as can be appreciated. Any technique that can be used to determine an average ambient sound level amplitude over a selected period of time may be used.

In one embodiment, the ambient noise level can be updated at selected intervals. For instance, the ambient noise level may be continuously monitored and updated every 6 seconds. This enables the ambient noise level to be adjusted to compensate for significant changes in ambient noise. Ambient noise levels may significantly change when a room suddenly becomes occupied by one or more persons or when another type of change occurs such as during a break time or a lunch time period. Ambient noise levels may also change with respect to machinery or the use of electronic equipment. Updating the ambient noise level at frequent intervals can further reduce the detection of false positives that may be reported as distressed sounds.

The actual rate of update of the ambient noise level may be selected based on system requirements and acoustic conditions in the room in which the system will be located. For instance, in a quiet office the update rate for the ambient noise level may be relatively slow, such as every 20 seconds. Alternatively, in a machine shop where heavy equipment are turned on and off, the rate of update may be relatively short, such as every 2 seconds to enable significant changes in acoustic noise to be taken into affect.

In one embodiment, if audio is detected that is a selected amount greater than the ambient noise level then the update rate may be turned off for a selected period so that the ambient noise level isn't inadvertently increased to be greater than the distressed sound. For instance, the update window may be turned off, allowing the ambient noise level to be maintained at the same level, for 10 seconds after the audio is detected as having an amplitude greater than the ambient noise level. The length of the update window and the turn-off period can be selected to provide an appropriate ambient noise level for the environment in which the telephony device is located that enables an ambient noise level to be determined that will minimize the reporting of false positives, as previously discussed.

Figure 2:
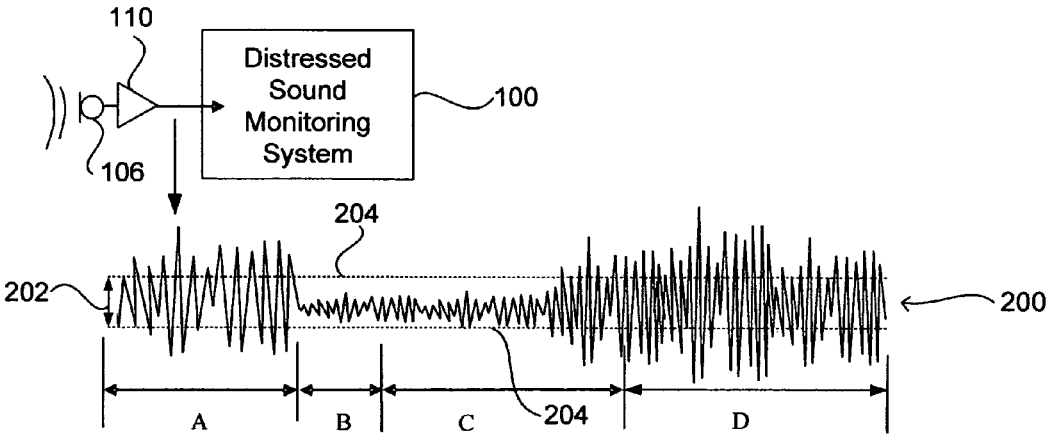
FIG. 2 illustrates an example waveform analyzed by the system of FIG. 1 in accordance with an embodiment of the present invention.

The sound processing module 108 is configured to process sounds received by the microphone that have an amplitude that is a selected amount greater than an amplitude of the ambient noise. For instance, FIG. 2 illustrates an example waveform 200 of an audio signal produced by the microphone 106 and output by the amplifier 110. The waveform is divided into different sections representing the signal at different periods.

Section A of the waveform 200 represents an audio signal that may be received during typical use of a digital telephone with the microphone 106. Typical use is referred to herein as "off hook". When the phone is off hook then the distressed sound monitoring system can be turned off.

Section B of the waveform 200 represents an audio signal when the phone is not in use and is "on hook". The audio signal represents ambient noise received at the microphone 106 and amplified by the amplifier 110. A distressed sound threshold 202 is represented by the dotted lines 204 that are positioned a selected distance away from an average ambient sound level. The actual position of the distressed sound threshold can be adjusted over time, as previously discussed, based on the ambient sound levels received. The distressed sound threshold is set at an amplitude that is a selected amount greater than an average value of the ambient noise level. The average value of the ambient noise level may be represented by two different levels, representing an average high signal level and an average low signal level relative to a baseline, such as zero volts or another direct current offset or selected baseline.

The distressed sound threshold 202 can be set at a selected level, such as four times (6 dB) the amplitude of the average high and low amplitude levels of the ambient noise waveform 200 in Section B. The actual distressed sound threshold level can be selected based on system criteria and the acoustics of the location in which the system is located. For instance, a room in which loud noises typically occur, such as a machine shop, may have a distressed sound threshold level that is greater than a room that is typically relatively quiet, such as an office. The distressed sound threshold may be measured with respect to a single level or may be set with an upper threshold value and a lower threshold value, as shown in FIG. 2 by the dotted lines 204.

In one embodiment, ambient noise amplitudes that occur within the distressed sound threshold level can be monitored by a microprocessor such as a digital signal processor using a relatively low resolution sampling mode. The use of a low resolution sampling mode can reduce the amount of power used to process the ambient noise.

Section C of the waveform 200 provides an example of an amplitude of the waveform increasing to a level greater than the distressed sound threshold level 202. When an amplitude of the audio signal received at the microphone 106 exceeds the distressed sound threshold level for a predetermined amount of time, such as 100 milliseconds, then the processor may be switched to a higher resolution sampling mode. The higher resolution sampling mode can be useful in determining whether the received audio signal substantially matches a predetermined acoustic model.

Speech recognition software can be used to compare the waveform 200 with predetermined statistical models of selected sounds. Speech recognition software typically uses a statistical model to determine whether a waveform matches a prerecorded waveform to identify a specific term. Speech recognition models such as the Hidden Markov models or Dynamic Time Warping based speech recognition can be used to create statistical models of selected words, phrases, and sounds. The digital signal processor can then sample the waveform 200 when the waveform has an amplitude greater than the distressed sound threshold 202 and compare the waveform with the statistical models to determine whether the waveform is substantially similar to a predetermined statistical model of a distressed sound. Sampling the waveform at a higher rate when the amplitude is greater than the distressed sound threshold enables a more accurate analysis to be performed between the waveform and the predetermined statistical models using speech recognition models.

Section D of waveform 200 represents an example waveform of a distressed sound that is greater than the distressed sound threshold 202. The distressed sound can be matched to a predetermined statistical model to identify the type of sound, word, or phrase represented by the waveform.

Figure 3:
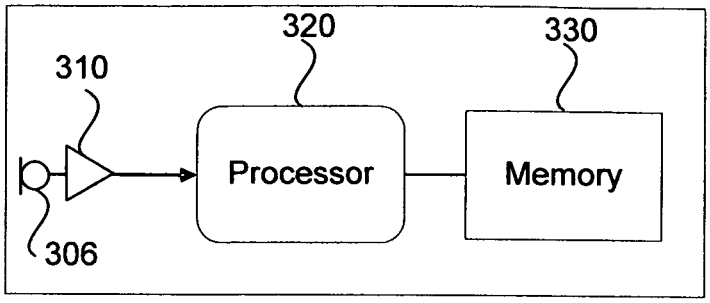
FIG. 3 illustrates a block diagram of an example device configured to operate the system of FIG. 1 in accordance with an embodiment of the present invention.

FIG. 3 provides a block diagram of one example illustration of a device 300 configured to operate the modules disclosed in FIG. 1. The device is comprised of a microphone 306, an amplifier 310, a microprocessor such as a DSP 320, and a digital memory 330. Acoustical energy is received by the microphone 306 and converted to an electrical signal that can be amplified by amplifier 310. The output of the amplifier is a waveform, such as the waveform 200 shown in FIG. 2. The processor can monitor ambient noise at a low resolution when the device 300 is not being used. An analog to digital converter may be used to convert the output of the amplifier to a digital representation of the waveform. The waveform can then be processed as previously discussed. When the amplitude of the waveform is greater than the distressed sound threshold then the waveform can be compared to and matched with a predetermined statistical model. The predetermined statistical models for desired words, phrases, and sounds can be stored in the digital memory 330 that is in communication with the processor 320.

The device 300 may be included in a digital telephone such as a desktop telephone, as previously discussed. In one embodiment, a digital telephone or group of digital telephones can be licensed to operate the modules illustrated in the system of FIG. 1. The device can also be incorporated in or licensed to operate in other types of communication devices, such as a cellular telephone, a handheld computing device, a tablet computing device, a desktop or laptop computing device, and so forth. The device can operate, as previously discussed, independent of the type of apparatus that the device is incorporated in, using the processor to analyze ambient noise to determine if a distressed sound is received with an amplitude greater than a distressed sound threshold. The level of the distressed sound threshold is set based on the amplitude of the average ambient noise.

Returning to FIG. 1, when the sound processing module 108 matches a distressed sound waveform from the noise detection module with a predetermined statistical model then the assistance request module 112 is configured to take an action based on the type of distressed sound that is detected. For instance, if the waveform substantially matches a statistical model for the word "fire" then the assistance request module can be configured to send a communication to a desired party, such as a building manager, a company safety officer, or a call to an emergency number to report the fire. The message may include an automated voice message, a text message, an email, or the like.

In addition to sending a request for assistance, the assistance request module 112 can be configured to communicate an audio track received by the microphone to an audio storage device for a selected period of time after the request for assistance has been transmitted. For instance, the audio track received by the microphone may be stored on a digital memory at the digital telephony device or at a location in communication with the digital storage device. In addition, the audio track may be communicated to the emergency number to enable the emergency responders to obtain additional information about the potential emergency.

The type of message that is sent by the assistance request module 112 may depend on the type of device that the system is operating in. A smart phone or other type of computing device may be capable of sending more complex information, such as text, audio and/or video. In addition to providing audio and location information, additional information may be provided as well. For instance, a digital telephony device, such as a smart phone or other type of computing device, may also include a digital camera. When a distressed sound is detected, pictures or video information can be forwarded with the audio information to the selected party. The visual information may be used to enhance a response team's understanding of conditions at the digital telephony device. Selected digital telephony devices can be provided with additional sensors, such as a temperature sensor or other environmental type sensors. The sensor information can be communicated to the selected party to enable them to provide the best response in view of the communicated information from the audio, visual, and environmental sensors. A desktop phone may be limited to sending an audio message. The message can be formatted to provide the desired communication to the selected party.

Other types of sounds, such as breaking glass or a more vague term such as "help" may be reported to a different party, such as a company's security team, depending on the type of detected sound. If the sound of a gunshot is detected then the assistance request module 112 may be configured to automatically send a report to an emergency response number, such as 911.

The assistance request module 112 can also be configured to announce that a request has been made. For instance, if the distressed sound monitoring system is implemented in a desktop phone, the phone's hands free speaker system can be used to play an automated message, such as "help has been requested" or "a request for assistance has been sent to the emergency response number". Alternatively a visual indicator announcing the receipt of the distress message and impending call for help may be used, either by itself, or in connection with an audible alert, such as a voice announcement.

In one embodiment, the assistance request module 112 can be configured to implement a delay between the announcement and actually sending the message. For instance, the announcement may report "A help request has been identified. A request for help will be sent in 5 seconds". A person can select cancel if the request is a false positive, for example by touching a cancel button, raising and hanging up the handset, or by entering a security code into the phone. For certain sounds, such as the sound of a gunshot, there may be no delay to eliminate the possibility of the request for help being cancelled by a potential perpetrator of a crime.

In one embodiment, a plurality of distressed sound monitoring systems 100 can be connected to a common server 120 or several interconnected servers. For instance, the distressed sound monitoring system can be implemented in a digital phone. A plurality of digital phones in a business or building can be connected to a telephony server such as a private branch exchange (PBX) server or another type of telephony server such as an internet protocol call server.

The server 120 can provide additional functionality. For instance, a call server can include information about each digital telephone that is connected, including information pertaining to the telephone's location in the building and the user of the telephone. This information can be of great benefit when a request for assistance has been sent. Caller ID information can be used by an emergency response crew to locate the building or company in which the telephone call was sent, but additional location information, such as where the phone is located in the building or buildings may not be available. The server can be configured to add location information to the request for assistance, such as identifying that the phone from which the request for assistance was sent is located on the $17^{th}$ floor, northwest office and is typically used by John Smith.

In one embodiment, the audio detected by the microphone of each idle digital telephony device connected to the server can be streamed to the server 120. The detected audio from each telephony device can then be processed at the server, or another location in a computing cloud, to determine if audio is received with an amplitude greater than the distressed sound threshold and also substantially matches a predetermined statistical model of a distressed sound, as previously discussed.

Multiple distressed sound monitoring systems 100 may all detect the same distressed sound. For instance, a loud shout, an explosion, or a gun shot may be detected by a plurality of desktop phones in an office building with an open architecture. In one embodiment, an approximate location of the distressed sound can be determined based on the amplitude of the sound detected by each of the plurality of desktop phones. The sound processing module 108 can identify an amplitude characteristic of the distressed sound. The amplitude characteristic may be a maximum amplitude, an amplitude over a period of time, or another means of identifying the relative distance of the sound with respect to the phone.

The amplitude characteristic can then be reported to the assistance request module 112. The amplitude characteristic may be reported on a scale, such as 0 to 100. The assistance request module can be configured to communicate the amplitude characteristic to the call server 120. When a plurality of assistance requests are received at the call server in a short time then the call server can be configured to identify an approximate location of the sound by forwarding the assistance request with the greatest amplitude characteristic to the desired party. Since the assistance request can also include location and identification information, identifying the request for assistance having the highest amplitude characteristic is likely closest to the source of the distress call. This will also reduce the chances of sending multiple requests that all pertain to the same potential distressed sound to the desired party, such as an emergency phone number. The assistance request module can also communicate video information and/or environmental information for a selected period of time after the request for assistance has been transmitted, as previously discussed.

Figure 4:
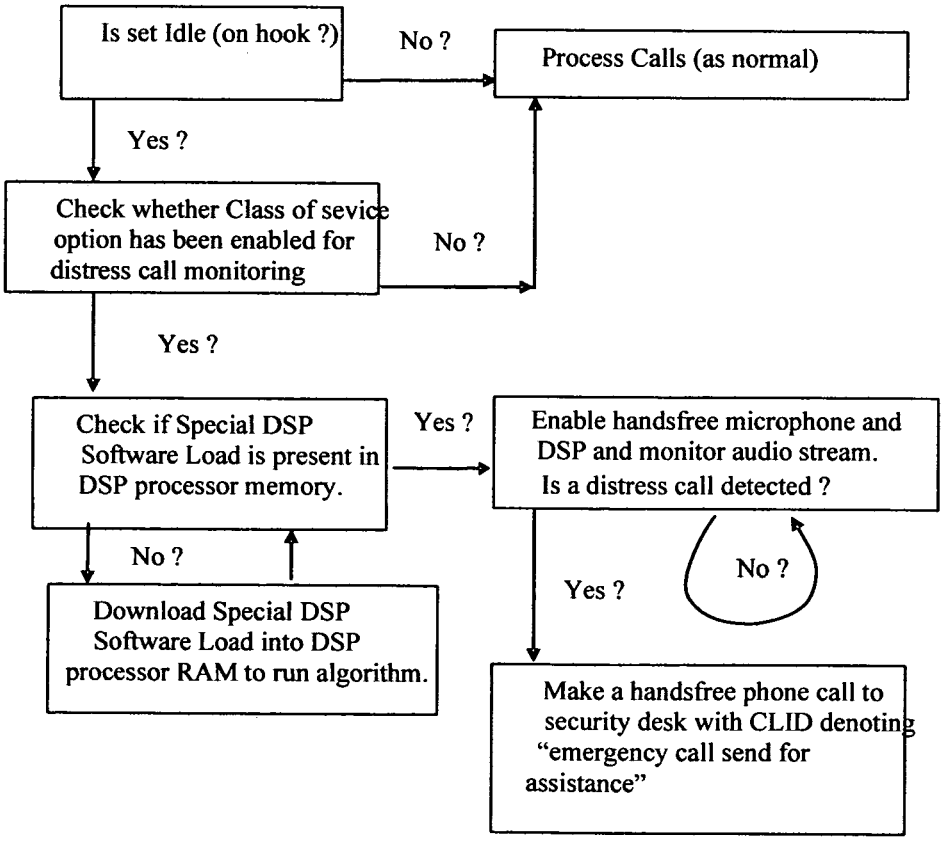
FIG. 4 illustrates an example flow diagram of a process for monitoring a distressed sound in accordance with an embodiment of the present invention.

FIG. 4 provides a flow chart illustrating one process used by a device such as a voice over internet protocol (VOIP) digital telephony device that is licensed to operate the system of FIG. 1. A determination can be made as to whether the telephony device is set to idle. If the device is being used then calls made on the device are processed as normal. If the device is not being used then a determination can be made of the device's class of service (COS) options. The COS options can include whether the phone can be used for long distance, for conference calls, and so forth. In one embodiment, each phone can be licensed to operate the system of FIG. 1. When a phone is licensed, then the COS option for distress call monitoring is enabled.

If the digital telephony device has a license to operate the system of FIG. 1 then a determination can be made as to whether the software needed to run the system has been loaded in the VOIP telephony handset. If not, the software can be downloaded to operate on the phone's digital signal processor and random access memory. Once the program is operating on the handset, and a determination is made that the phone is not in use, then the hands free microphone or other type of microphone can be enabled and the audio detected by the microphone can be monitored. When a distress call is detected then a request for assistance can be communicated. The request for assistance may be a call to a desired location, such as a security desk with the caller ID denoting a message such as "emergency call send for assistance".

Figure 5:
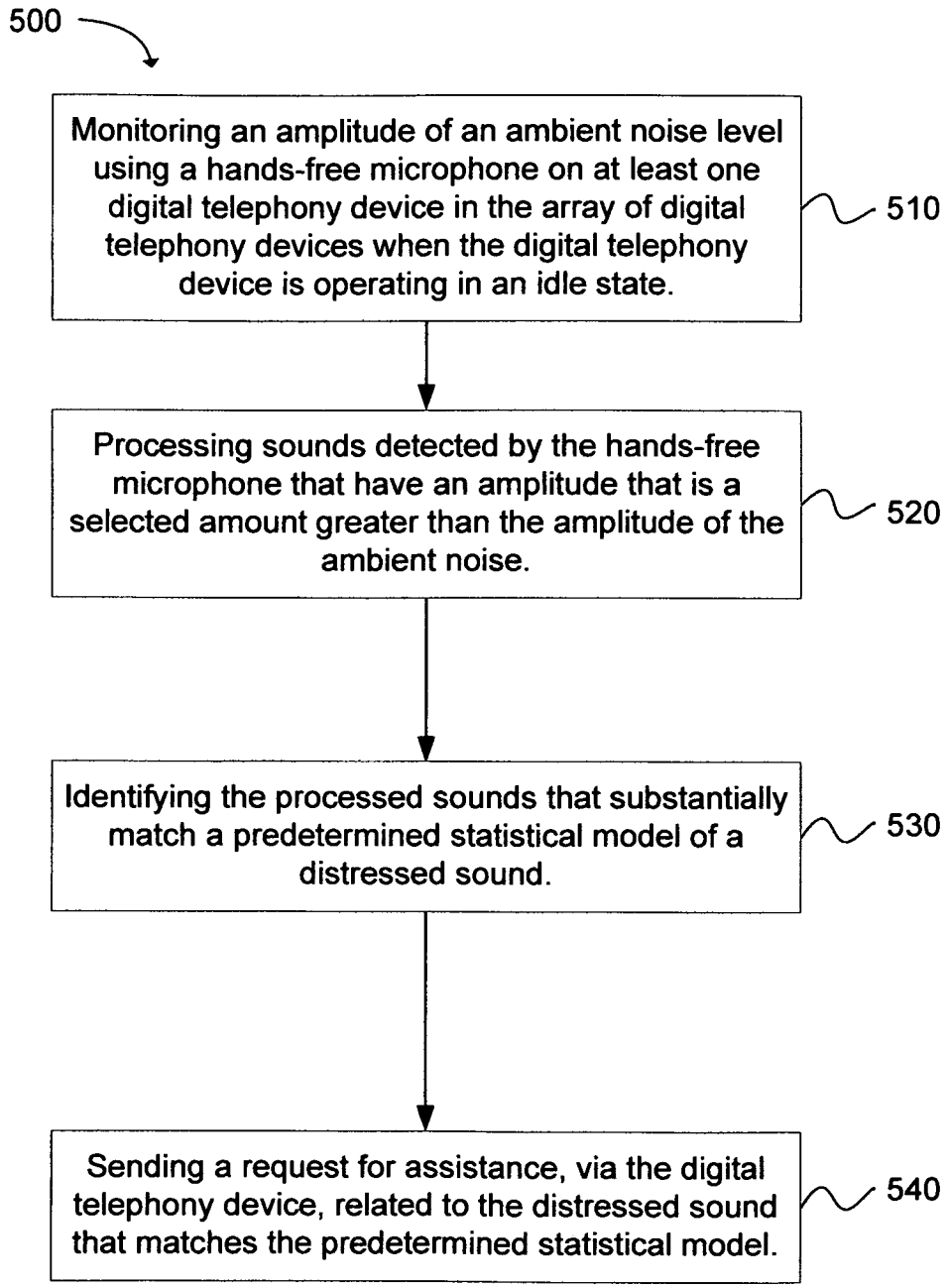
FIG. 5 depicts a flow chart of a method for monitoring a distressed sound in accordance with an embodiment of the present invention.

In another embodiment, a method 500 for monitoring for a distressed sound using an array of digital telephony devices in communication with a digital telephony server is disclosed, as depicted in the flow chart of FIG. 5. The method includes the operation of monitoring 510 an amplitude of an ambient noise level using a microphone on at least one digital telephony device in the array of digital telephony devices. In one embodiment, the microphone may be a hands-free microphone. The monitoring can occur when the digital telephony device is operating in an idle state. Other types of microphones, such as a microphone on a smart phone or other type of computing device may be used as well, as previously discussed. Sounds detected by the microphone that have an amplitude that is a selected amount greater than the amplitude of the ambient noise can be processed 520. The processed sounds that substantially match a predetermined statistical model of a distressed sound can be identified 530. A request for assistance related to the distressed sound can be sent 540 via the digital telephony device when the distressed sound matches the predetermined statistical model.

The request for assistance can include information pertaining to the location of the digital telephony device. The digital telephony devices in the array may be located in separate rooms, on separate floors, or even in different buildings. The location information can be obtained from a digital telephony server to which the digital telephony device is connected. The location information may be identified by the digital telephony server based on information stored in the server for each digital telephony device connected to the server. When multiple requests for assistance are received within a short period, such as within 10 seconds, then the location information can be obtained by analyzing the amplitude characteristic sent with each request for assistance, as previously discussed.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

It should be understood that many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. The modules may be passive or active, including agents operable to perform desired functions.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as defacto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method of monitoring for a distressed sound using an array of digital telephony devices in communication with a digital telephony server, comprising:

monitoring an amplitude of an ambient noise level using a microphone on at least one digital telephony device in the array of digital telephony devices only when the digital telephony device is operating in an idle state and turning off monitoring when said at least one digital telephony device is off hook;

processing sounds detected by the microphone that have an amplitude that is a selected amount greater than the amplitude of the ambient noise;

identifying the processed sounds that substantially match a predetermined statistical model of a distressed sound; and sending a request for assistance, via the digital telephony device, related to the distressed sound that matches the predetermined statistical model.

2. The method of claim 1, wherein monitoring the ambient noise level further comprises monitoring the ambient noise level with a digital signal processor operating in each of the at least one digital telephony devices, respectively.

3. The method of claim 1, further comprising processing the sounds detected by the microphone at the digital telephony server.

4. The method of claim 1, further comprising creating a statistical model for a plurality of distressed sounds.

5. The method of claim 1, further comprising setting the digital telephony device to record audio received by the microphone when the processed sound matches the predetermined statistical model.

6. The method of claim 1, wherein sending a request for assistance further comprises sending a request for assistance at a location of the digital telephony device.

7. The method of claim 6, further comprising determining a location of the digital telephony device through information contained on the digital telephony server.

8. The method of claim 1, further comprising sending an amplitude characteristic from the digital telephony device to the digital telephony server with each request for assistance.

9. The method of claim 8, further comprising analyzing the amplitude characteristic from a plurality requests for assistance to determine a location of the request based on a digital telephony device reporting a greatest amplitude characteristic.

10. A system for monitoring for a distressed sound comprising:

a noise detection module configured to monitor ambient noise through a microphone on a digital telephony device and determine an ambient noise level, monitoring occurring only when the digital telephony device is operating in an idle state and turning off monitoring when the digital telephony device is off hook;

a sound processing module configured to process sounds received from the microphone that have an amplitude a selected amount greater than an amplitude of the ambient noise and determine if the processed sounds match a predetermined statistical model of a distressed sound; and an assistance request module configured to send a request for assistance via the digital telephony device for processed sounds that match the predetermined statistical model of the distressed sound.

11. The system of claim 10, further comprising a plurality of digital telephony devices connected to a digital telephony server, with a selected number of the digital telephony devices licensed to operate the noise detection module, the sound processing module, and the assistance request module.

12. The system of claim 10, further comprising a processor configured to process the sounds received from the microphone, the processor selected from the group consisting of a digital signal processor (DSP), a field programmable gate array (FPGA) processor, a central processing unit (CPU), a microcontroller, and an application specific integrated circuit (ASIC).

13. The system of claim 10, wherein the noise detection module is further configured to calculate an average ambient noise level over a selected time period.

14. The system of claim 10, wherein the sound processing module is further configured to identify an amplitude characteristic of a processed sound that matches the predetermined statistical model of the distressed sound.

15. The system of claim 14, wherein the assistance request module is further configured to send the amplitude characteristic with the request for assistance to a telephony server to enable the telephony server to identify an approximate location of the distressed sound when multiple requests for assistance are received in a selected period.

16. The system of claim 10, wherein the assistance detection module is further configured to communicate a location of the digital telephony device with the request for assistance.

17. The system of claim 10, wherein the assistance request module is further configured to communicate an audio track received by the microphone to an audio storage device for a selected period of time after the request for assistance has been transmitted.

18. The system of claim 10, wherein the assistance request module is further configured to communicate at least one of video information and environmental information for a selected period of time after the request for assistance has been transmitted.

19. A method of monitoring for a distressed sound using a digital computing device in communication with a digital telephony device, comprising:

monitoring ambient noise using a microphone coupled to the digital computing device only when the digital computing device is operating in an idle state and turning off monitoring when the digital computing device is off hook;

identifying sounds that substantially match a predetermined statistical model of a distressed sound; and sending a request for assistance related to the distressed sound from the digital computing device to an assisting party via the digital telephony service.

20. The method of claim 19, wherein monitoring ambient noise further comprises monitoring ambient noise using a microphone coupled to the digital computing device, wherein the digital computing device is selected from the group consisting of a cellular telephone, a handheld computing device, a tablet computing device, a desktop computing device, and a laptop computing device.

* * * * *